United States Patent [19]

Linossi

[11] 4,401,142

[45] Aug. 30, 1983

[54] COMBINATION PLANING, SAWING, MILLING AND MORTISING APPARATUS

[75] Inventor: Valentino Linossi, Sauris, Italy

[73] Assignee: Zinken Italiana S.p.A., Milan, Italy

[21] Appl. No.: 259,326

[22] Filed: Apr. 30, 1981

[30] Foreign Application Priority Data

May 8, 1980 [IT] Italy ..... 21765/80[U]

[51] Int. Cl.[3] ..... B27C 9/04

[52] U.S. Cl. ..... 144/1 R; 144/3 R; 144/286 R

[58] Field of Search ..... 144/286 R, 286 A, 1 R, 144/1 B, 1 H, 3 R

[56] References Cited

U.S. PATENT DOCUMENTS 2,662,566 12/1953 Kurschner ..... 144/1 R
3,352,334 11/1967 Hunn ..... 144/1 R
3,368,596 2/1968 Comer ..... 144/1 R

*Primary Examiner*—W. D. Bray
*Attorney, Agent, or Firm*—Allison C. Collard; Thomas M. Galgano

[57] ABSTRACT

A combination planer comprises at least one sawing tool, at least one cutter tool and at least one mortising tool, mounted on members movable with respect to the bed of the machine, the latter including a movable table or deck driven for up and down movement. Between the movable supporting members for the tools and the movable table there are provided clutch members which, in one position thereof, provide kinematic connection between the movable supporting members and the table to displace the tool from the inoperative to the operative position, whereas, in another position thereof, they are effective to disengage the kinematic connection to make inoperative a respective tool.

4 Claims, 6 Drawing Figures

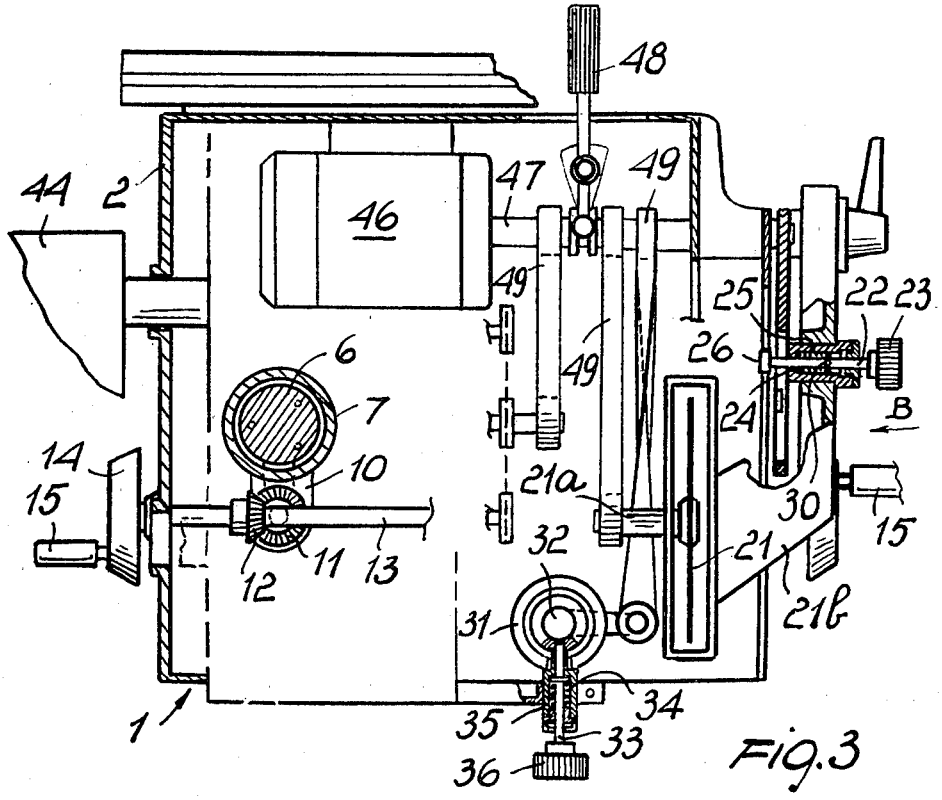
Fig.3
Fig.4
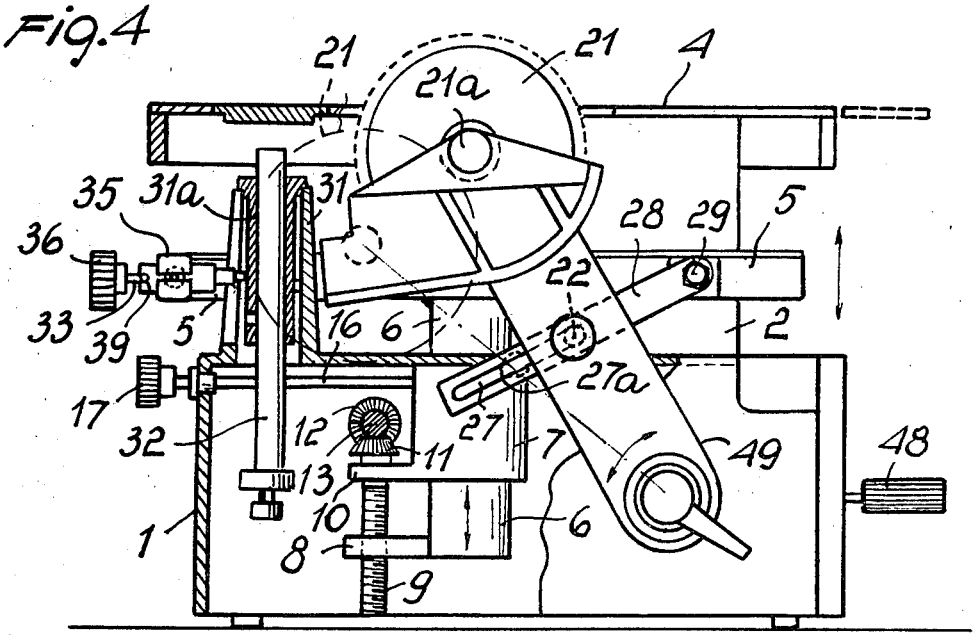

18
19
20
4
19b
21
21a
23
40
43
41
42
C
45
15
14
44
32
21
14
19a
36

40
42
41
45
44
43
2
35
36
39
5
16
17
49
13
12
11
10
48
7
1
46
47
6
9
8

COMBINATION PLANING, SAWING, MILLING AND MORTISING APPARATUS

BACKGROUND OF THE INVENTION

This invention relates to a combination planer with sawing, milling, and mortising capabilities.

Combination machines of the foregoing general type have been known, wherein the tool bits are operated, that is moved from their inoperative positions to their operative positions, by manual control. Such apparatus, in particular the ones intended for hobbyists, further comprise tables which are controlled manually to occupy different height positions relatively to the workpiece.

The need for manually moving the tool bits, or at least some of them, namely the ones more frequently used, from the inoperative position to the operative one, represents a drawback both from the constructional and functional standpoints.

SUMMARY OF THE INVENTION

A primary object of this invention is to eliminate such drawbacks by providing some improvements by the virtue whereof simple arrangements of clutch members at either of two positions allow the linking of kinematics means, effective to operate said movements (i.e. from the inoperative position to the operative one), toward the movable table which, as mentioned, is a standard component for such machines, so that said movement can only occur by translating said table.

Additional advantages and objects are achieved by the machine according to the invention, which is of a type including at least one sawing tool, at least one cutter tool and at least a mortising tool being mounted on members arranged to be movable with respect to the stationary bed of the machine and comprising a movable table or deck driven for up and down movement by generally manual actuation, characterized in that between said movable supporting members for said tools and the movable table or deck there are provided clutch members which, in one switch over position, provide kinematic connection between said movable supporting members and said table or deck, whereas in the other switch over position, they disconnect said kinematic connection, thereby, in the connected position, the actuation of said table or deck in up and down directions causes a displacement of the tool mounted on said supporting member from the inoperative to the operative position, or viceversa.

More specifically, the clutch members comprise small pins having at one end a knob and at the other end constituting the engagement member with the movable supporting member, said pins being slidably movable inside a bushing against the bias of a spring, said bushing being made rigid with said movable table.

Advantageously, a movable supporting member may comprise a hollow cylindrical support, wherein a tube is slidable which carries a tool bit control shaft. According to a further feature, the movable supporting member may comprise a rocker arm associated with another arm provided with a slit, wherein there is slidable, in link-like relationship, said small pin of the clutch member.

BRIEF DESCRIPTION OF THE DRAWINGS

Further advantages and features will become more apparent from the following description of a machine capable of illustratively implementing the inventive concept, which description is related to the accompanying diagramatical exemplary drawing, where:

FIG. 3 is in part a plan view and in part a horizontal sectional view of that same machine;

FIG. 4 is a side elevational view taken in the direction of the arrow B of FIG. 3, with parts shown in vertical section;

DESCRIPTION OF THE PREFERRED EMBODIMENTS

Figure 1:
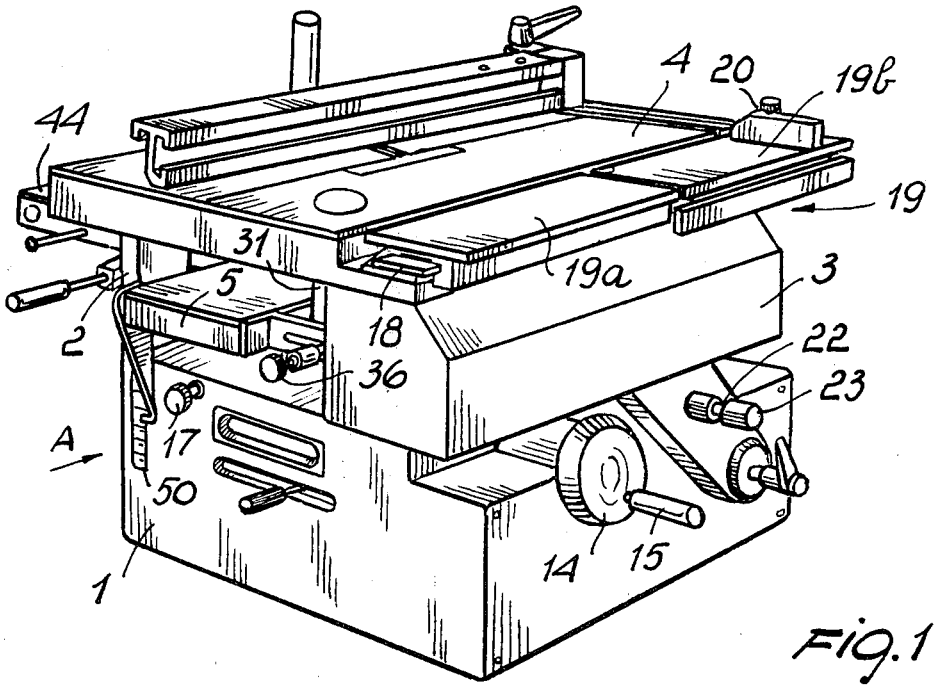
FIG. 1 is a perspective view of a machine according to the invention.

With general reference to the drawing figures, the machine comprises a bed 1 which carries at the top two lateral supporting bodies 2 and 3 which support the upper deck 4. Between the bodies 2 and 3, there is left a space, wherein there is located the lower deck or table 5, as carried by the piston-pillar 6, slidable in a cylindrical body 7 made rigid with the bed 1. The piston 6 has a side lug 8 which is formed with an axial threaded bore acting as a nut, wherein the screw 9 can be turned, carried at the bottom by the bed and at the top by a lug 10 on the cylindrical body 7. To the top end of the screw 9 there is connected a bevel gear wheel 11 adapted for meshing with a mating bevel gear wheel 12 mounted on a small shaft 13, carried at **13*a* (see FIG. 2) on the bed 1, and to the free outer end whereof is connected a handwheel 14 with crank handle 15. On the bed 1, there is also supported, partly by thread engagement a rod 16, the external end whereof to the bed is provided with a knob 17, the inner end penetrating, through a hole in the cylindrical body 7, toward the piston 6, to thus lock it in the operating position set with the handwheel 14**.

The upper deck 4 has a laterally arranged cross-piece 18 (FIG. 2), whereon a side deck 19 is slidably mounted which comprises two half-decks **19*a* and 19*b* aligned with each other on the same plane. The deck 19*b* has its internal longitudinal edge hinged to an element slidable on said cross-piece 18 so that deck 19*b* can be lifted, that is inclined, with respect to the plane 4 in order to permit a plank (not shown), placed on deck 19*b*, to be sawn at a desired angle by a disk saw 21, which disk saw 21 is protruding, vertically, from the slit existing between the edge of the plane 4 and the edge of the decks 19*a*–19*b*. On the deck 19*b* is also placed a square bracket 20** which serves as a resting element for the plank to be sawn.

As mentioned, the machine comprises a plurality of tools, and in particular the cited saw 21, a cutter for edge milling planks, a planar and a slotter for working through the thickness of the plank.

The disk saw 21 can assume, according to the invention, either of two positions, an inoperative one, whereat it is withdrawn, i.e. positioned below the deck 4 (as shown in dash lines in FIG. 4), and an operative one, as shown in full lines in FIG. 4. More specifically, a pin 22, to the end whereof a knob 23 is attached, is pushed outwardly relative to the machine by a spring 24 accommodated in a bushing 25 which carries said pin 22; the latter has a larger diameter cylinder (relatively to the pin) as indicated at 26, located at the free end thereof. The pin has a diameter dimension which is almost equal to the width dimension of a slit 27, formed in one arm 28, which is swivel connected at 29 to the movable table or deck 5.

The saw 21 is rotatably keyed on the shaft 21*a* supported by a load bearing arm 21*b* which, at its opposite end, is rotatably mounted upon the stationary bed 1; in the middle position of arm 21*b* there is accommodated the cited bushing 25 which carries pin 22.

The pin 22 has a locating pin 30, which can be inserted, in a manner known per se, for a single position of rotation of the knob 23, into a cutout formed in the bushing. The slit 27 is provided, in the proximity of one end thereof, with a widening portion 27*a* which is so configured as to rotatably accommodate the cylinder 26 of the pin 22. In the drawing, said widening portion 27*a* is shown displaced along the slit with respect to its actual position (which is near one end of the slit) for a clearer view.

Therefore, the saw 21, supported by the arm 21*b*, can be moved into two positions (operative and inoperative) by the movement of the solely movable deck 5; in fact, for moving the saw 21 toward the operative position (as in FIG. 2) it is sufficient to act for rotation a knob 23 in order to insert the pin 30 into a cutout of the bushing 25; as a consequence, the end cylinder 26 of the pin 22 enters into the slit 27 of the oscillatable arm 28 and then, by acting on the movable deck 5, when said cylinder 26 has reached the widening position 27*a* of the slit 27, the oscillating arm 28 causes the oscillation of the arm 21*b* which brings the saw 21 into the operative position.

For the machine, the invention provides two positions for the cutter as well, which can disappear under the deck 4 or work at a preset depth with respect to said deck or table. The bed 1 includes a hollow cylindrical upright 31 (see FIG. 4) wherein is slidable a bushing 31*a* made rigid with the shaft 32 of the a milling tool (not shown in the drawings) of the known type. The hole at the bottom portion of the bushing 31*a* receives a small shaft 33 biased by the internal spring 34 to a bushing 35. Within that system, rigid with the lower deck or table 5, the bushing 35 receives the small shaft under control by a knob 36 and the compressive bias of the spring 34.

Thus, in the cutter or milling mode of operation, the knob will be turned such that the small pin 39 moves into alignment with its groove in the bushing 35, and the small shaft 33 will be displaced axially and caused to bear on the bushing 31*a* which carries the cutter spindle. However, upon the small shaft reaching a position of alignment with its seating bore, it will snap into engagement with the bushing.

Figure 5:
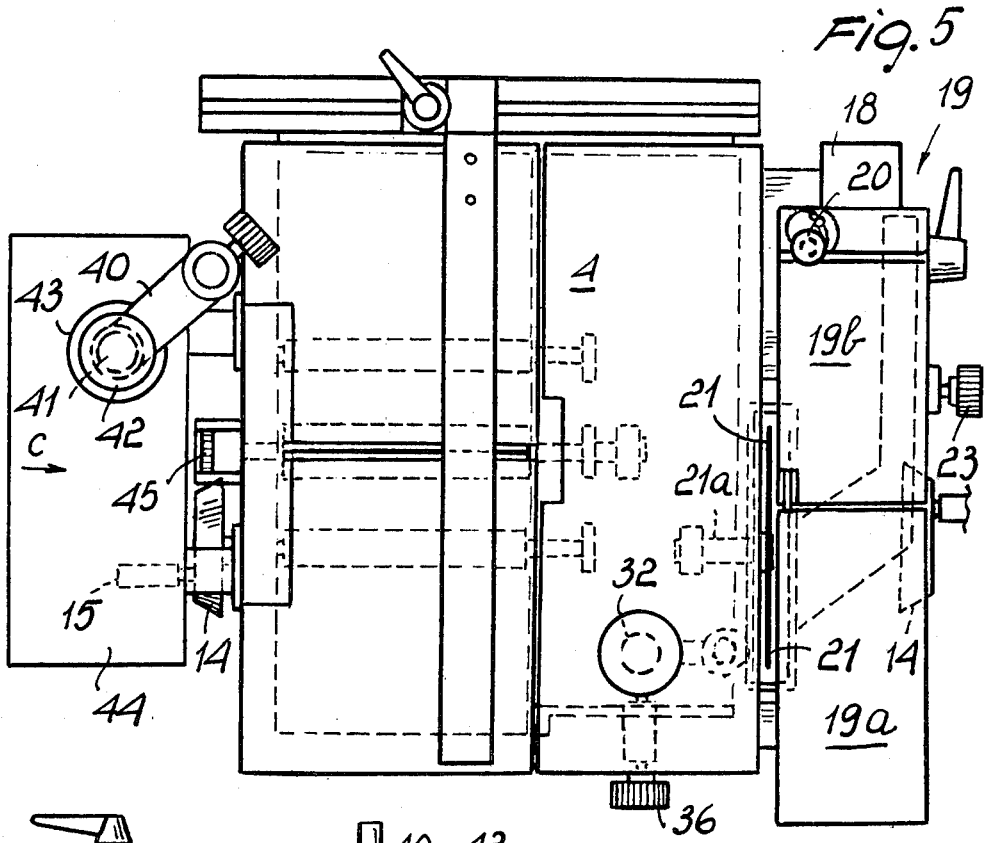
FIG. 5 is a plan view.
Figure 6:
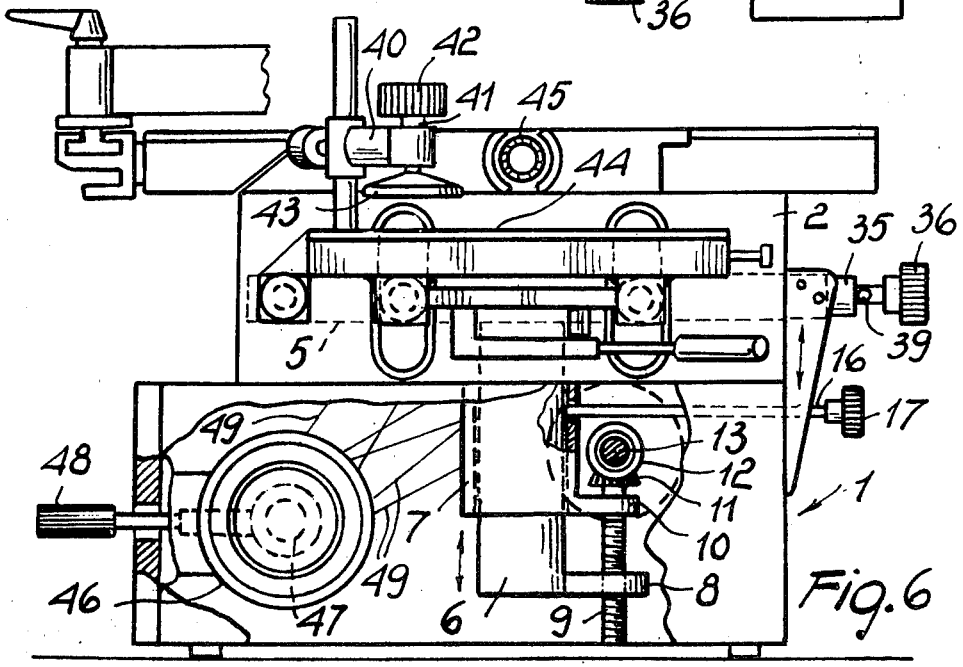
FIG. 6 is a further side elevation view, in the direction of the arrow C of FIG. 5, partly shown in vertical section.

On the opposite side to that where the saw 21 is located, the deck 4 has an arm 40 which can carry a shaft 41 provided, at the top, with a knob 42 and, at the bottom, with a plate 43 which functions to clamp, against the backing deck 44 rigid with the movable deck 5, a plank to be mortised with a mortise 45 (FIG. 5) known per se.

Finally, the drawing shows a motor 46, shaft 47, coupling lever 48 and several belt drives 49, adapted to transmit, in a manner known per se, the movement to the various tools to be powered.

As explained hereinabove, the invention is unique in that it affords the possibility of actuating at will either the sawing tool or cutter tool, in an automated manner, by simply applying an up and down movement to the table or movable deck 5. In fact, the only required operation is that of rotating either the knob 23 or knob 36, such that the pins which are rigid with said knobs establish the kinematic connection, respectively with the bushing 31 or arm 28, and this during the translation of the movable deck or table 5 by rotation of the handwheels 14.

Figure 2:
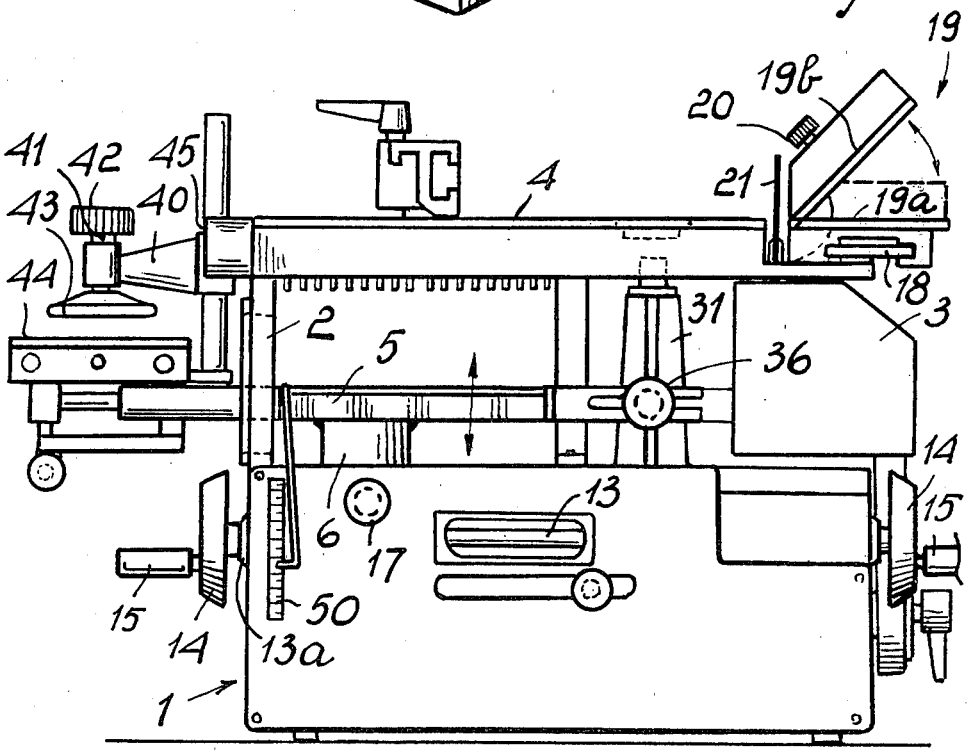
FIG. 2 is a side elevation view taken in the direction of the arrow A of FIG. 1.

In practice, when a milling operation is planned, the table will be lowered by means of the clutching system whereto it is connected until the small shaft snaps into the bushing bore, which bushing being engaged, is allowed to raise to a desired height level through the indexing pointer 50 relatively to its scale (see FIG. 2).

In order to raise the table or lower deck, the handwheels 14 must be turned, which in turn transmit rotation to the bevel gear drive 11,12 actuating the screw 9. That power screw will raise the piston 6 rigid with the table 5. To the latter table or lower deck, there is connected the deck of the plate with the slit 27 which links the arm of the saw by means of its clutch system and the cutter clutch system. The two clutch systems may be operated independently of each other, and it will be possible to leave the saw or the cutter inoperative, or to bring into the operative position either tool in a completely independent manner. Accordingly, by operating the handwheel 14, the planer table or deck can be raised to a desired level, while leaving the saw or the cutter inoperative, which will then be at work such as to leave the table unobstructed.

In practicing the invention, the materials used, as well as the dimensions and contingent shapes, may be any ones, depending on individual requirements.

I claim:

1. A combination planing, sawing, milling and mortising apparatus, comprising:

a stationary bed;

a sawing tool;

a milling tool having a milling tool shaft;

a mortising tool;

a manually activatable movable deck supported for vertically-displaceable movement with respect to said stationary bed;

adjustable backing means supported by said movable deck for positioning a workpiece to be mortised; and movable support means for supporting said tools for movement relative to said stationary bed, said support means including:

(a) an oscillatable support arm coupled to said sawing tool and pivotably mounted on said stationary bed, a swivel arm pivotably connected to said movable deck and a first pin-like clutch member for coupling and uncoupling said swivel arm and said support arm, so as to permit, in one position thereof, displacement of said sawing tool solely by means of the movement of said movable deck;

(b) a stationary hollow support mounted on said stationary bed, a bushing slidably mounted in said hollow support, which bushing carries said milling tool shaft, and a second pin-like clutch member for coupling and uncoupling said milling tool shaft-carrying bushing and said movable deck; and (c) a shaft rotatably supported by said stationary bed and coupled to said mortising tool and cooperating with said adjustable backing means for positioning the workpiece to be mortised.

2. The apparatus of claim 1, wherein said swivel arm pivotably connected to said movable deck has a longitudinal slit in which a pin-like member, supported by said oscillatable support arm for said sawing tool, is slidable in a link-like relationship during the movement of said movable deck.

3. The apparatus of claim 1, wherein said pin-like clutch member for said sawing tool comprises a small pin having at one end thereof a knob and with its other end configured to serve as an engagement member for engagement with said movable swivel arm, said small pin being axially slidable in a bushing against the bias of a spring, said bushing being fixed relative to said oscillatable support arm.

4. The apparatus of claim 1, wherein said pin-like clutch members, are each coupled to a manual control knob disposed externally of said apparatus.

* * * * *